US008062083B2

(12) United States Patent
Shaw

(10) Patent No.: US 8,062,083 B2
(45) Date of Patent: Nov. 22, 2011

(54) LINE CUTTER

(75) Inventor: Robin David Shaw, Winchester (GB)

(73) Assignee: Ambassador Marine Limited

( * ) Notice: Subject to any disclaimer, the term of this patent is extended or adjusted under 35 U.S.C. 154(b) by 96 days.

(21) Appl. No.: 12/444,620

(22) PCT Filed: Sep. 11, 2007

(86) PCT No.: PCT/GB2007/003458

§ 371 (c)(1),
(2), (4) Date: Apr. 7, 2009

(87) PCT Pub. No.: WO2008/032063

PCT Pub. Date: Mar. 20, 2008

(65) Prior Publication Data

US 2010/0075553 A1 Mar. 25, 2010

(30) Foreign Application Priority Data

Sep. 11, 2006 (GB) ..... 0617828.9

(51) Int. Cl.
*B63H 1/28* (2006.01)

(52) U.S. Cl. ..... 440/73; 416/146 R

(58) Field of Classification Search ..... 440/73; 416/146 R

See application file for complete search history.

(56) References Cited

U.S. PATENT DOCUMENTS

| | | | | |
|---|---|---|---|---|
| 218,438 | A | 8/1879 | Heath | |
| 4,447,215 | A | 5/1984 | Govan | |
| 4,676,758 | A | 6/1987 | Dennis | |
| 4,801,281 | A * | 1/1989 | Govan | 440/73 |
| 4,938,724 | A * | 7/1990 | Shaw | 440/73 |
| 4,943,249 | A * | 7/1990 | Govan | 440/73 |
| 4,954,108 | A * | 9/1990 | Govan | 440/73 |
| 5,017,167 | A * | 5/1991 | Govan | 440/73 |
| 5,052,957 | A * | 10/1991 | Govan | 440/73 |
| 5,192,191 | A | 3/1993 | Tasaki | |
| 5,807,150 | A * | 9/1998 | Minter, Sr. | 440/73 |
| 6,004,174 | A * | 12/1999 | Govan | 440/73 |

FOREIGN PATENT DOCUMENTS

| | | |
|---|---|---|
| FR | 2 507 562 | 12/1982 |
| GB | 2 110 307 | 6/1983 |
| GB | 2 139 169 | 11/1984 |
| GB | 2 204 549 | 11/1988 |
| GB | 2204549 | 11/1988 |

* cited by examiner

*Primary Examiner* — Lars A Olson

(74) *Attorney, Agent, or Firm* — Jennifer Meredith, Esq.; Meredith & Keyhani, PLLC

(57) ABSTRACT

A line cutter 1 is fitted at a propeller 2 on a shaft 3 carried in a stern tube 4. Clamped to the shaft immediately in front of the propeller is a rotatable cutting blade unit 11 comprising a split hub 12, having two halves 121, 122, one of which carries one rotating blade 14 and the other of which carries two further blades 15. Bolts 16 clamp the halves to the shaft. A split collar 17 is clamped together and to the hub by bolts 17*a* at a machined groove 17*b* in the hub to provide a location groove 18 for a stationary cutting blade unit 21. This assembly has a single blade 22 integral with a half ring 23. A second half ring 24 is clipped by interlocking formations 23*a*, 23*b* to the first half ring. The two half rings are accommodated in the location groove 18, with the interposition of thrust washers 18*a*, 18*b*.

5 Claims, 4 Drawing Sheets

LINE CUTTER

The present invention relates to a cutter for lines potentially fouling a propeller.

In our earlier U.S. Pat. No. 2,204,549, I have described a line cutter having:

a rotatable cutting blade unit mountable for rotation with the propeller shaft and including at least one rotatable cutting blade extending generally radially of the propeller shaft and having a cutting edge provided between an axially directed face and a circumferentially directed face; and a stationary cutting blade unit adapted to be restrained against rotation by co-operation with the shaft bearing and including a stationary cutting blade extending generally radially of the propeller shaft, having a cutting edge provided between an axially directed and a circumferentially directed face and arranged for cutting action of its cutting edge in conjunction with the cutting edge of the or each rotatable cutting blade on rotation of the propeller shaft with the axially directed faces passing opposite each other during such rotation;

wherein the cutting edge of the or each rotatable cutting blade and/or the cutting edge of the stationary cutting blade is/are provided with serrations, and the cutting edges are shaped for cutting action of radially inner ones of the serrations prior to such action of radially outer serrations on continued rotation of the propeller shaft.

That line cutter used a Vee block on the propeller shaft stern tube and a nose within the Vee on the stationary blade for restraining the stationary blade against rotation. The rotatable blade used a substantial bearing for locating the stationary bearing both radially and axially.

The object of the present invention is to provide an improved line cutter.

According to the invention there is provided A line cutter for mounting at a propeller itself mounted on a propeller shaft, the line cutter comprising:

a rotatable cutting blade unit mountable fixedly with the propeller shaft for rotation therewith and including:

at least one cutting blade extending generally radially of the propeller shaft and a pair of opposed thrust surfaces;

a stationary cutting blade unit adapted to be restrained against rotation and having:

a stationary cutting blade and a pair of opposed thrust surfaces complementary to the thrust surfaces of the rotatable cutting blade unit for locating the stationary cutting blade unit with respect to the rotatable cutting blade unit for line cutting; and means for restraining the stationary cutting blade against rotation, wherein:

the restraining means includes a fixable member having a bore at least substantially parallel with the propeller shaft in use and the stationary cutter has a spigot sized as a sliding fit in the bore for location of the stationary cutter.

It has been found that by restraining the stationary blade assembly in this manner, namely with its spigot received in the bore in the fixed member, it does not need to be located radially by bearings between in it and the rotatable blade, which are sized to accommodate forces generated in cutting a line potentially fouling the propeller. Thus the bearings between the assemblies can be reduced in capacity, with consequential economy in size and material.

Accordingly, the stationary cutting blade unit is located both radially and rotationally with respect to the rotatable cutting blade unit only by the spigot engaging in the bore.

In accordance with a preferred feature, the spigot is made hollow, allowing water to flow through it and collapse any cavitation bubble liable to form behind it.

Normally, the fixed member will be an integral part of or be attached to a collar to be clamped onto a stern tube. However, it can be envisaged that the fixed member could be a feature of the stern tube or indeed of a casing of an outboard motor.

The rotatable cutting blade unit can be mounted either on the propeller shaft adjacent the propeller or on the propeller, with the assembly and a part of the propeller being complementarily machined.

In one embodiment, the stationary cutting blade is formed integrally with an open clevis, the stationary cutting blade extending oppositely from limbs of the clevis and having its thrust surfaces formed on the limbs of the clevis, and restrained in use from radial movement away from the rotatable cutting blade unit by engagement of the spigot in the fixable member, with the limbs of the clevis received between the thrust surfaces of the rotatable cutting blade unit.

Alternatively, the stationary cutting blade can be formed integrally with a ring which is openable for fitting and closed in use around a hub of the rotating blade assembly, the stationary cutting blade extending away from the ring and having its thrust surfaces formed on the ring, with the ring received between the thrust surfaces of the rotatable cutting blade unit.

To help understanding of the invention, a two embodiments thereof will now be described by way of example and with reference to the accompanying drawings, in which.

Figure 1:
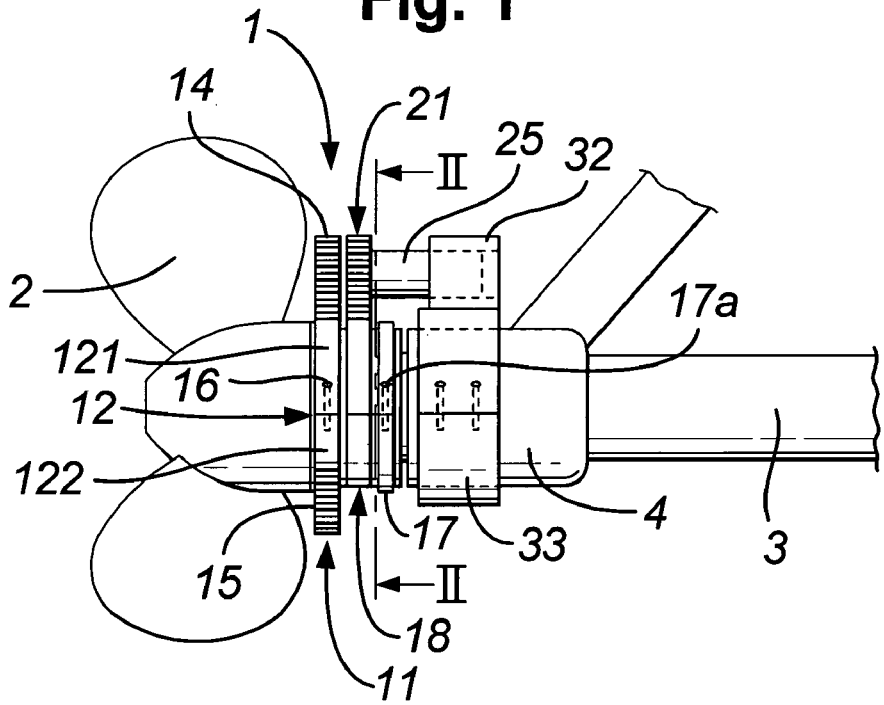
FIG. 1 is a side view of a marine propeller with a line cutter of the invention.
Figure 2:
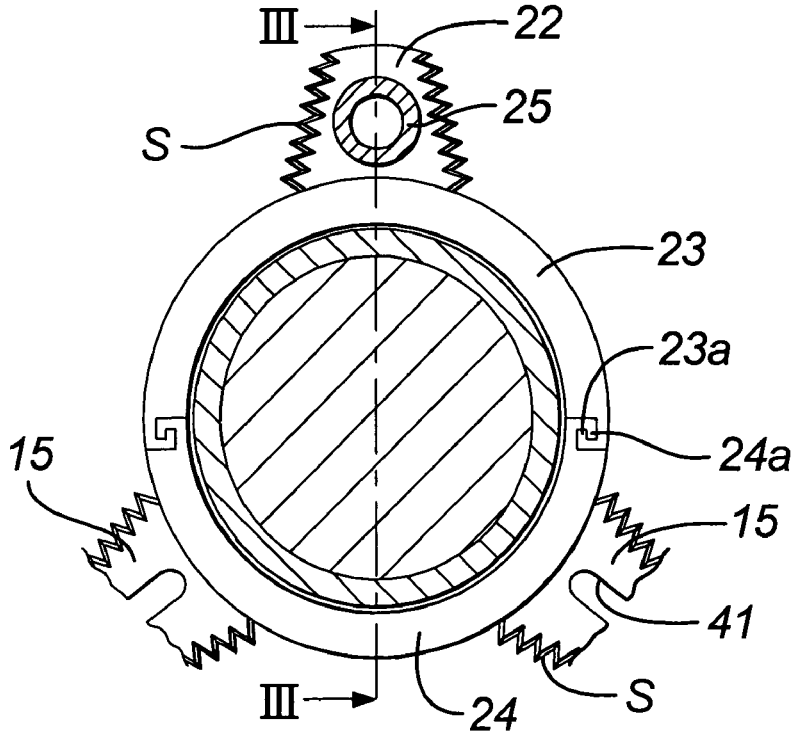
FIG. 2 is a cross-sectional end view on the line II-II in FIG. 1, on a larger scale.
Figure 3:
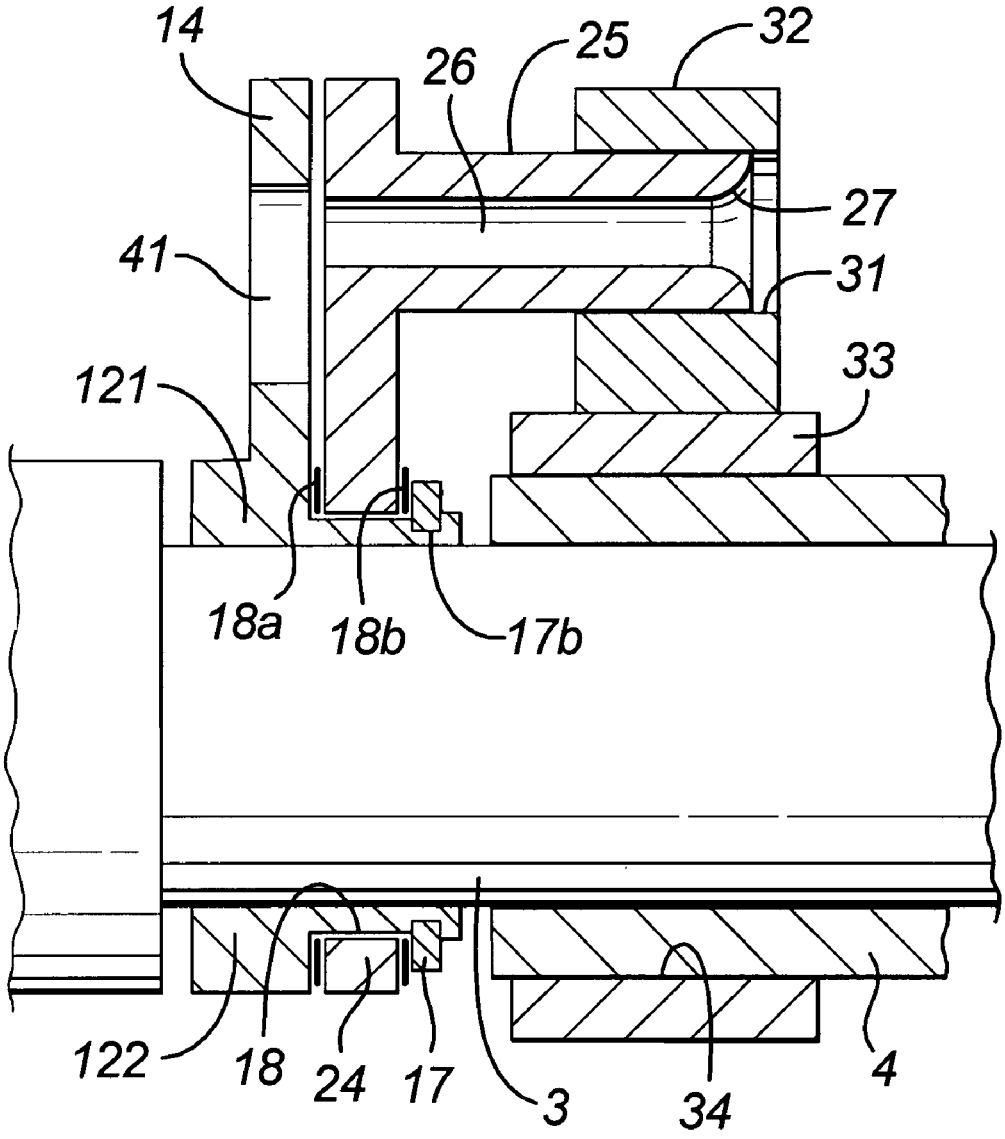
FIG. 3 is a cross-sectional side view on the line III-III in FIG. 2.

Referring to the drawings, the line cutter 1 is fitted at a propeller 2 on a shaft 3 carried in a stern tube 4.

Clamped to the shaft immediately in front of the propeller is a rotatable cutting blade unit 11 comprising a split hub 12, having two halves 121, 122, one of which carries one rotating blade 14 and the other of which carries two further blades 15. Bolts 16 clamp the halves to the shaft. A split collar 17 is clamped together and to the hub by bolts 17*a* at a machined groove 17*b* in the hub to provide a location groove 18 for a stationary cutting blade unit 21.

This assembly has a single blade 22 integral with a half ring 23. A second half ring 24 is clipped by interlocking formations 23*a*, 24*a* to the first half ring. The two half rings are accommodated in the location groove 18, with the interposition of thrust washers 18*a*,18*b*.

The blades are formed to cross initially at their inner ends on relative rotation and have serrations S formed on them for separating a sizeable line into portions for cutting it. The thrust washer 18*a* holds the blades from direct contact.

The arrangement so far described is conventional.

In accordance with the invention, the stationary blade 22 has a machined, circular cross-section spigot 25 extending forwards. This is received in a complementary bore 31 in a block 32 integral with a split collar 33 clamped to the stern tube 4 around the shaft journalled in the stern tube. The bore 31 is parallel with the internal bore 34 of the collar, whereby the bore 31 and spigot 25 are parallel with the propeller shaft. Thus the stationary blade is located radially and circumferentially. It is further located axially of the shaft by its half ring engaging in the location groove 18.

Should the shaft move axially as with thrust direction change from open throttle to closed throttle, the stationary cutter is able to move with the shaft.

Should a rope become fouled between the stationary blade and one of the rotating blades, the serrations S on the blades part it into bundles of fibres, which are cut between the serrations. The force in this is reacted by the spigot. This removes load from the half rings 23,24, allowing them to be smaller and lighter than in prior cutters.

To reduce the drag of the line cutter and in particular that of the stationary blade, the spigot has a through bore 26, with a tapered inlet. 27. Flow of water through it reduces the tendency for a cavitation bubble to form behind it. Further the rotating blades 14,15 also have drag reduction slots 41.

Figure 4:
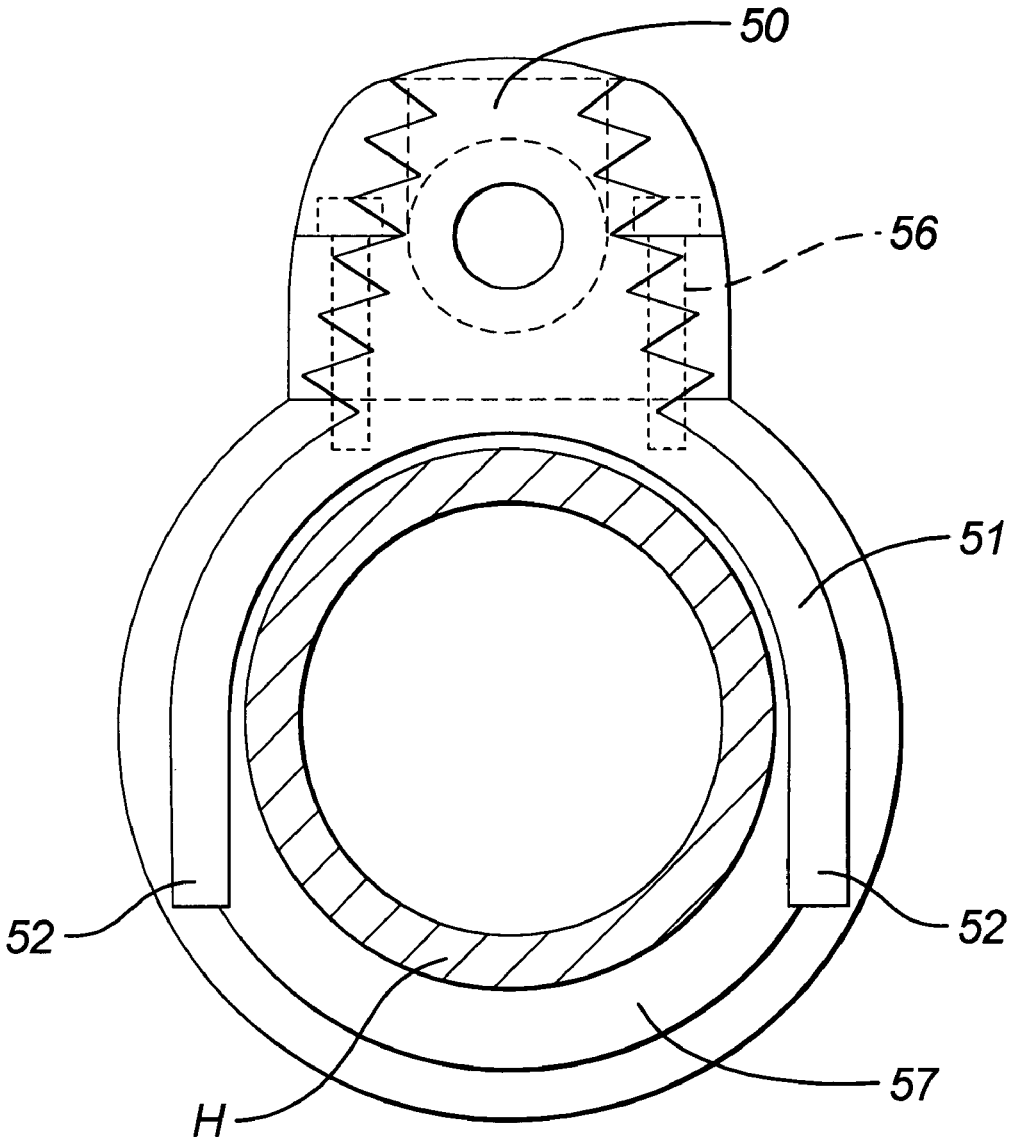
FIG. 4 is a cross-sectional end view on the line IV-IV in FIG. 5 of a second line cutter of the invention.
Figure 5:
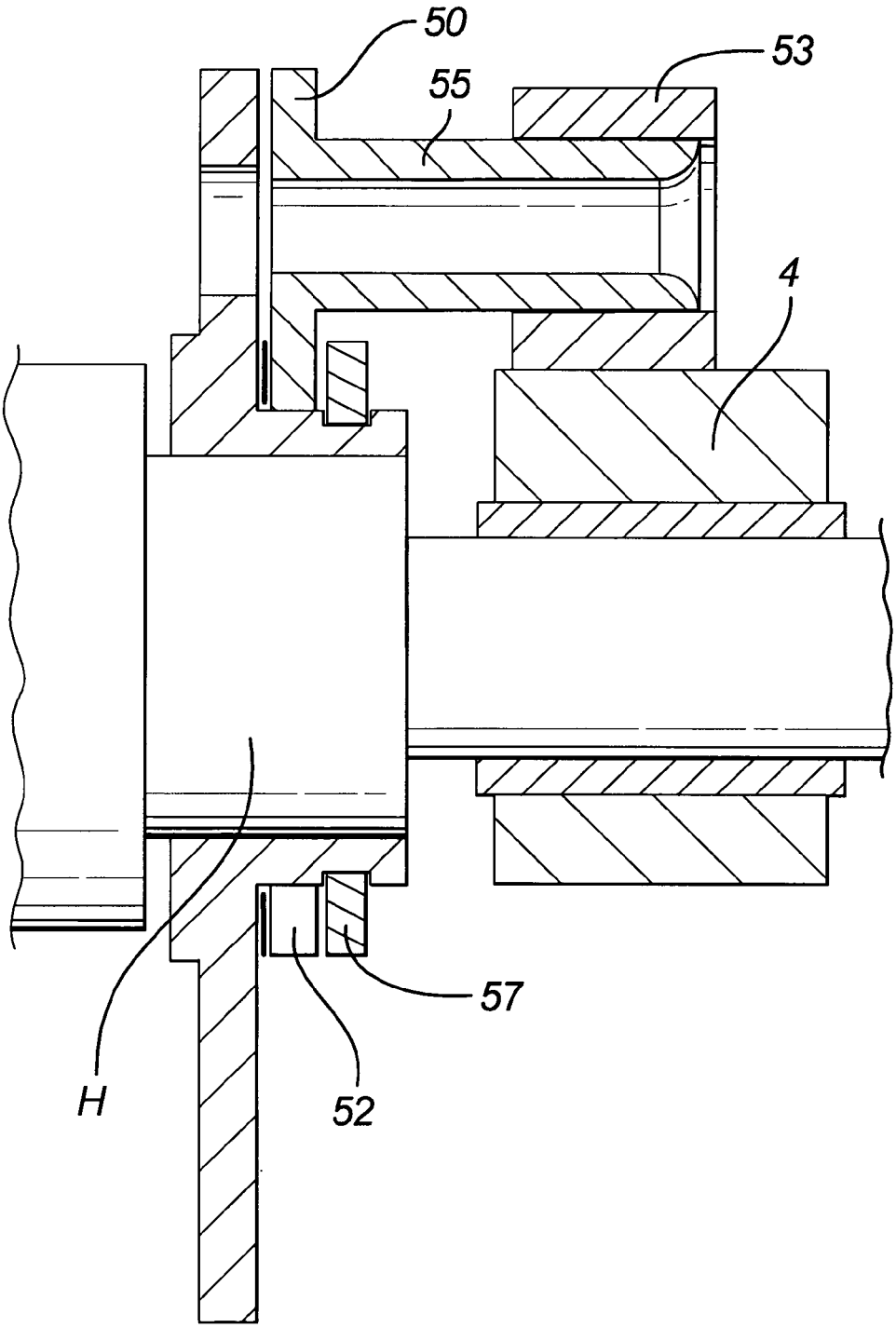
FIG. 5 is a cross-sectional side view on the line V-V in FIG. 4.

Referring on to FIGS. 4 & 5, stationary blade 50 thereshown is provided with a clevis 51 in place of the half rings and the split location collar 57 is formed of bearing material, whereby a separate thrust bearing is not required at its side of the clevis limbs 52. Further, the reaction block 53 for the stationary blade spigot 55 is attached directly to the stern tube 4. Furthermore, the rotating cutting blade unit is clamped by bolts 56 directly to the hub H of the propeller as opposed to the propeller shaft.

The invention is not intended to be restricted to the details of the above described embodiment. For instance, the complementary hooks 23*a*, 24*a* can be replaced by bolts securing the two halves of the stationary cutting blade ring together.

The invention claimed is:

1. A line cutter for mounting at a propeller itself mounted on a propeller shaft, the line cutter comprising:

a rotatable cutting blade unit mountable fixedly with the propeller shaft for rotation therewith and including:

at least one cutting blade extending generally radially of the propeller shaft and a pair of opposed thrust surfaces;

a stationary cutting blade unit adapted to be restrained against rotation and having:

a stationary cutting blade and a pair of opposed thrust surfaces complementary to the thrust surfaces of the rotatable cutting blade unit for locating the stationary cutting blade unit with respect to the rotatable cutting blade unit for line cutting; and means for restraining the stationary cutting blade against rotation, wherein:

the restraining means includes a fixable member having a bore at least substantially parallel with the propeller shaft in use and the stationary cutter has a spigot sized as a sliding fit in the bore for location of the stationary cutter;

wherein the fixable member is an integral feature of a stem tube or of a casing of an outboard motor.

2. A line cutter for mounting at a propeller itself mounted on a propeller shaft, the line cutter comprising:

a rotatable cutting blade unit mountable fixedly with the propeller shaft for rotation therewith and including:

at least one cutting blade extending generally radially of the propeller shaft and a pair of opposed thrust surfaces;

a stationary cutting blade unit adapted to be restrained against rotation and having:

a stationary cutting blade and a pair of opposed thrust surfaces complementary to the thrust surfaces of the rotatable cutting blade unit for locating the stationary cutting blade unit with respect to the rotatable cutting blade unit for line cutting; and means for restraining the stationary cutting blade against rotation, wherein:

the restraining means includes a fixable member having a bore at least substantially parallel with the propeller shaft in use and the stationary cutter has a spigot sized as a sliding fit in the bore for location of the stationary cutter;

wherein the stationary cutting blade is formed integrally with an open clevis, the stationary cutting blade extending oppositely from limbs of the clevis and having its thrust surfaces formed on the limbs of the clevis, and restrained in use from radial movement away from the rotatable cutting blade unit by engagement of the spigot in the fixable member, with the limbs of the clevis received between the thrust surfaces of the rotatable cutting blade unit.

3. A line cutter for mounting at a propeller itself mounted on a propeller shaft, the line cutter comprising:

a rotatable cutting blade unit mountable fixedly with the propeller shaft for rotation therewith and including:

at least one cutting blade extending generally radially of the propeller shaft and a pair of opposed thrust surfaces;

a stationary cutting blade unit adapted to be restrained against rotation and having:

a stationary cutting blade and a pair of opposed thrust surfaces complementary to the thrust surfaces of the rotatable cutting blade unit for locating the stationary cutting blade unit with respect to the rotatable cutting blade unit for line cutting; and means for restraining the stationary cutting blade against rotation, wherein:

the restraining means includes a fixable member having a bore at least substantially parallel with the propeller shaft in use and the stationary cutter has a spigot sized as a sliding fit in the bore for location of the stationary cutter;

wherein the stationary cutting blade is formed integrally with a ring which is openable for fitting and closed in use around a hub of the rotating blade assembly, the stationary cutting blade extending away from the ring and having its thrust surfaces formed on the ring, with the ring received between the thrust surfaces of the rotatable cutting blade unit.

4. A line cutter as claimed in claim 3, wherein the ring of the stationary cutting blade ring comprises two half rings hooked to each other.

5. A line cutter as claimed in claim 3, wherein the ring of the stationary cutting blade ring comprises two half rings bolted to each other.

* * * * *